US005899667A

United States Patent [19]

Greer

[11] Patent Number: 5,899,667

[45] Date of Patent: May 4, 1999

[54] FLUID COMPRESSOR WITH SEAL SCAVENGE AND METHOD

[75] Inventor: Mark R. Greer, Charlotte, N.C.

[73] Assignee: Ingersoll-Rand Company, Woodcliff Lake, N.J.

[21] Appl. No.: 08/831,674

[22] Filed: Apr. 10, 1997

[51] Int. Cl.[6] ..... F04B 23/00; F01C 21/04

[52] U.S. Cl. ..... 417/53; 417/313; 418/88; 418/100

[58] Field of Search ..... 417/53, 313, 121, 417/148; 418/88, 100; 184/55.1, 55.2, 6.23

[56] References Cited

U.S. PATENT DOCUMENTS

| | | | |
|---|---|---|---|
| 4,063,855 | 12/1977 | Paul | 418/84 |
| 4,896,890 | 1/1990 | Mauney | 277/3 |
| 5,004,407 | 4/1991 | Hutchison | 418/1 |
| 5,028,205 | 7/1991 | Kapadia et al. | 415/112 |
| 5,033,944 | 7/1991 | Lassota | 418/1 |
| 5,171,130 | 12/1992 | Kume et al. | 417/228 |
| 5,176,505 | 1/1993 | Horii et al. | 417/295 |
| 5,667,367 | 9/1997 | Kubo et al. | 417/313 |

*Primary Examiner*—Charles G. Freay
*Assistant Examiner*—Paul L. Ratcliffe
*Attorney, Agent, or Firm*—Michael M. Gnibus

[57] ABSTRACT

A fluid compressor including a compression module driven by a prime over, a separator tank having a separation chamber, a scavenge flow connector having a T-shaped housing that is adapted to produce scavenge vacuum pressure to drain lubricant from a scavenge cavity when the fluid compressor is continuously running loaded.

17 Claims, 2 Drawing Sheets

FLUID COMPRESSOR WITH SEAL SCAVENGE AND METHOD

BACKGROUND OF THE INVENTION

The invention relates to a fluid compressor with seal scavenge system and method, and more particularly to a seal scavenge system that includes means for scavenging lubricant from a scavenge cavity when the fluid compressor is continuously running loaded.

During operation of a fluid compressor, a compression module or airend is driven by a prime mover to compress a fluid. A lubricant, such as oil, is used to lubricate prime mover component parts, and the lubricant frequently and undesirably leaks past prime mover seals and collects in a scavenge cavity. In order to use the collected lubricant in the compression module, fluid compressors frequently include scavenge systems whereby the collected lubricant is drained out of the scavenge cavity. Conventional scavenge systems use the vacuum produced when cycling the compressor by loading and unloading, to drain the collected lubricant out of the scavenge cavity and inject the lubricant into the uncompressed fluid stream as the uncompressed fluid flows into the compression module.

Since the vacuum required to drain the collected lubricant out of the scavenge cavity in conventional scavenge systems is produced by loading and unloading the compressor, no scavenge vacuum is produced when the compressor is continuously running loaded. As a result, when the compressor is continuously running loaded, collected lubricant is not drained from the cavity. Since fluid compressors are frequently operated continuously loaded, it would be desirable to provide a scavenge system that permits the collected lubricant to be drained from the scavenge cavity when the compressor is continuously running loaded.

The foregoing illustrates limitations known to exist in present devices and methods. Thus, it is apparent that it would be advantageous to provide an alternative directed to overcoming the limitation set forth above. Accordingly, a suitable alternative is provided including features more fully disclosed hereinafter.

SUMMARY OF THE INVENTION

In one aspect of the present invention, this is accomplished by providing a fluid compressor including a compression module having a fluid inlet for flowing uncompressed fluid into the compression module and a discharge port for flowing compressed fluid out of the compression module; a prime mover for driving the compression module, a means for joining the airend and prime mover, the prime mover and means for joining the airend and prime mover defining a scavenge cavity; and a separator tank having a separator inlet, the separator inlet being flow connected in fluid receiving relation with the compression module discharge port, said separator vessel further including a separator element which defines a separation chamber.

The fluid compressor also includes a scavenge system comprising; a scavenge flow connector having a scavenge housing with a first scavenge housing inlet port, a second scavenge housing inlet port, a scavenge housing discharge port, a first passage flow connecting the first scavenge housing inlet port and the scavenge housing discharge port, a second passage flow connecting the second scavenge housing inlet port and the first passage, said system also comprising a separator scavenge line having a first end located in the separation chamber and a second end located in the first passage; and a first flow line flow connecting the scavenge cavity with the second scavenge housing inlet port; and a second flow line flow connecting the scavenge housing discharge port with the compression module fluid inlet.

The foregoing and other aspects will become apparent from the following detailed description of the invention when considered in conjunction with the accompanying drawing figures.

DESCRIPTION OF THE DRAWING FIGURES

FIG. 1 is a schematic representation of a first embodiment fluid compressor that includes the scavenge flow connector of the present invention; and FIG. 2 is a schematic representation of a second embodiment fluid compressor that includes an alternate embodiment scavenge flow connector.

DESCRIPTION OF THE PREFERRED EMBODIMENT

Figure 1:
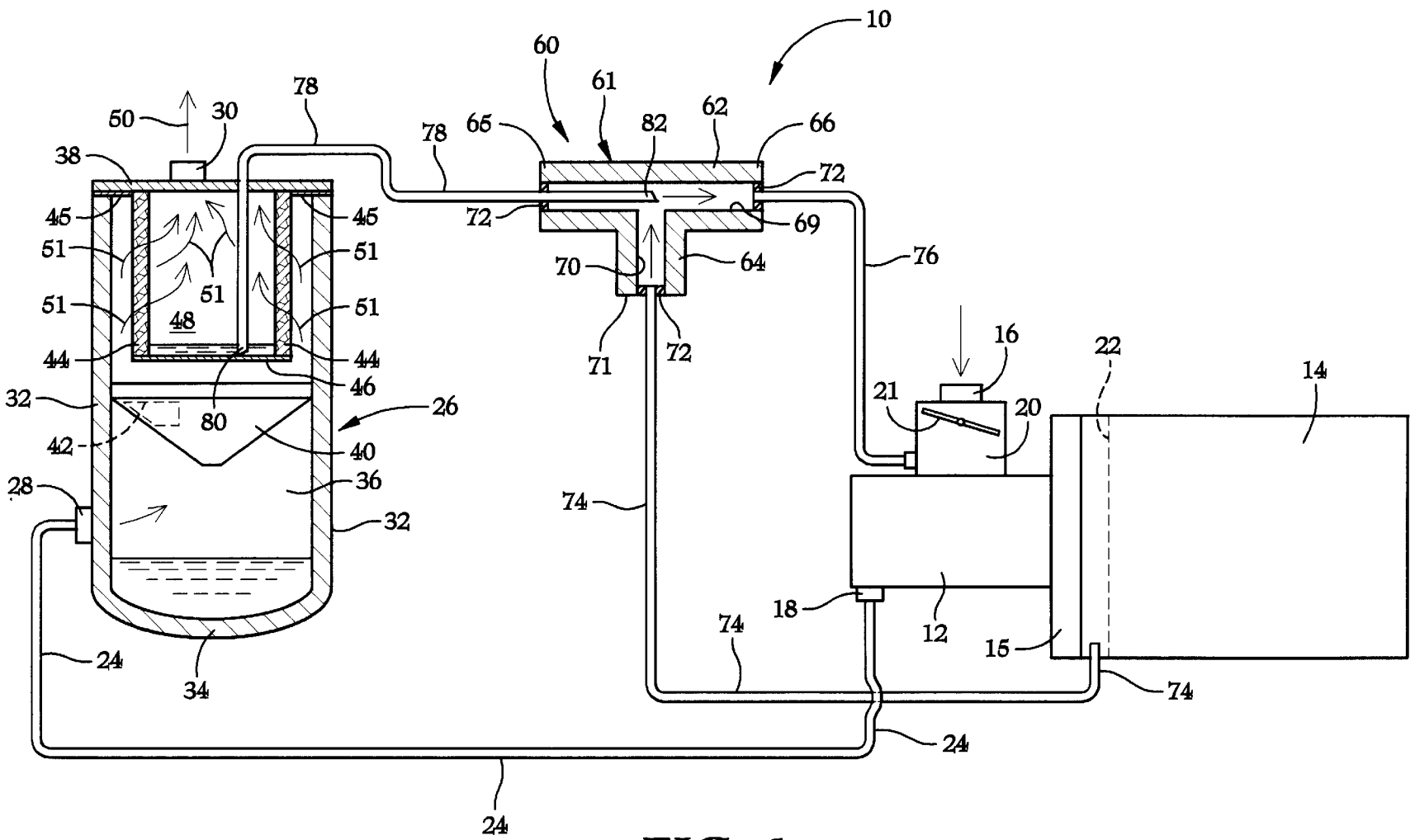

Turning now to the drawings wherein like parts are referred to by the same number throughout the several views, FIG. 1 is a schematic representation of a first embodiment fluid compressor identified generally at 10.

Fluid compressor 10 includes a compression module or airend 12 that is connected to and driven by a prime mover 14 via adapter means 15. The adapter may be a gear case for example. The adapter means and prime mover, when mated together define a scavenge cavity 22. The compression module 12 is an oil-flooded type compression module well known to one skilled in the art, with male and female interengaging rotors (not shown) which compress a fluid such as air that is flowed into the compression module through compression module inlet 16. Prime mover 14 may be an electric motor.

A mixture comprised of compressed fluid and lubricant mixed with the fluid during compression, flows out of the compression module through discharge port 18. An inlet valve 20, which may be a butterfly valve for example, controls the volume of uncompressed fluid that is flowed into the compression chamber. The inlet valve includes a flow adjusting means 21 which is adjusted during operation of compressor 10 to effect the flow of uncompressed fluid into the compression module. In FIG. 1, flow adjusting means 21 is represented schematically as a butterfly-type means.

Conventional seals (not shown) located between the adapter means 15 and prime mover 14 prevent a significant volume of the compression module lubricant from leaking from the adapter 15 and into scavenge cavity 22. However a small volume of lubricant typically collects in the scavenge cavity 22 during continued operation of the fluid compressor 10. This volume of collected lubricant is drained from the scavenge cavity in the manner which will be described hereinbelow.

Flow line 24 connects the compression module discharge port 18 with inlet port 28 of separator tank 26. The separator tank is shown in cross-section in FIG. 1. The separator tank serves to separate lubricant from the compressed fluid so that substantially lubricant-free compressed fluid is supplied to an object of interest, such as an air tool, through separator tank discharge port 30. The flow line 24 may be a pipe, hose or the like.

The separator tank 26 has cylindrical sidewall 32 and semi-spherical sump 34. The sidewall and sump define a primary separation chamber 36. As shown in FIG. 1, cover plate 38 is supported on the upper edge of sidewall 32 and closes the open discharge end of the separator tank.

A cone shaped baffle 40 is located in the primary separation chamber above separator tank inlet 28. The outer periphery of the upper portion of the baffle is welded or otherwise conventionally connected to the sidewall 32. The baffle includes a flow opening 42 through which the compressed fluid/lubricant mixture passes through the baffle, toward discharge port 30. Initial separation of the lubricant and compressed fluid occurs both centrifugally as the mixture flows around the outer periphery of the cone-shaped baffle and also through impingement with the baffle. The initially separated lubricant falls downward, and is collected in the sump 34.

The compressed fluid/lubricant mixture flows through the baffle opening 42 upward through cylindrical filter element 44. As shown in FIG. 1, an integral filter element flange 45 is sandwiched between the sidewall 32 and the cover plat to hold the filter element in place during operation of the separator 26. The mixture passes through the filter 44 in the direction identified by arrows 51. The filter is closed along the bottom by base plate 46, and the filter 44, cover plate 38 and base plate 46 define a secondary separation chamber 48. Lubricant that is separated from the compressed fluid by the filter 44 is collected on the base plate 46 in secondary separation chamber 48.

The substantially lubricant free compressed fluid is flowed out of separator tank 26 through discharge port 30 in the direction of arrow 50.

Scavenge system 60 allows lubricant collected in scavenge cavity 22 to be drained from the scavenge cavity both when the fluid compressor 10 is running loaded and also when the compressor is unloaded. System 60 includes a scavenge flow connector 61 having a T-shaped housing that is shown in cross-section in FIG. 1. The scavenge flow connector housing is comprised of a tubular conduit 62 that is made integral with stem 64. The tubular conduit has an inlet end 65, a discharge end 66 and a first passage 69 joining the ends 65 and 66. As shown in FIG. 1, the stem is made integral with the tubular conduit between the ends 65 and 66. A second passage 70 joins the inlet end 71 of stem 64 and the first passage 69.

Seal members 72 are located at inlet ends 65 and 71 and at discharge end 66. For purposes of describing the preferred embodiment of the invention the seal members are flexible o-ring seals however the seal members may be any suitable seal members.

Scavenge system 60 also includes flow lines 74, 76, and 78 which may be pipes, hoses or the like. Flow line 74 flow connects the scavenge cavity 22 and the stem inlet 71. Flow line 76 flow connects discharge end 66 and the inlet valve 20. As shown in FIG. 1, it is preferred that the flow connection between the inlet valve 20 and flow line 76 be made downstream from the inlet control means 21. The seal members 72 are wedged between the respective flow line 74, 76, and 78, and a portion of the scavenge flow connector housing 61 to form the required seal.

Flow line 78 flow connects secondary separation chamber 48 and passage 69. The flow line 78 has a first end 80 located closely adjacent to base plate 46 and a second end 82 located at a point at least halfway between tubular conduit ends 65 and 66. It is preferred that the end 82 be located adjacent to or downstream from passage 70 of stem 64. As shown in FIG. 1, end 82 is located above passage 70. In this way, the required vacuum to draw the lubricant from cavity 22 is supplied.

Operation of compressor 10 will now be described.

Compression module 12 is driven by prime mover 14 to compress a fluid flowed into the compression module through inlet valve 20. Oil is injected into the compression module to cool the fluid during compression, and the injected oil mixes with the fluid as it is compressed. The mixture of compressed fluid and lubricant, is discharged from the compression module out discharge port 18, through flow line 24 and into separator tank primary separation chamber 36.

A portion of the volume of lubricant mixed with the compressed lubricant is separated from the compressed fluid by baffle 40 in the manner previously described. The mixture then flows through separator element 44 and substantially all of the remaining lubricant is separated from the compressed fluid, and is collected in secondary separation chamber 48 on base plate 46.

The lubricant collected on base plate 46 along with a volume of compressed fluid flows through flow line 78, and out end 82, into passage 69. The flow of compressed fluid through the secondary separation chamber 48, forces the mixture through flow line 78. The mixture flows out discharge end 66 through flow line 76 and is introduced in inlet valve 20 downstream from the uncompressed fluid flowed through the inlet valve. The mixture is mixed with the uncompressed fluid.

As the mixture is flowed into the passage 69, the flow of the mixture produces a vacuum in passage 70 and in this way, lubricant collected in scavenge cavity 22 is drained out of the cavity through flow line 74, into passage 70, and finally into passage 69. The lubricant drawn out of scavenge cavity 22 then mixes with the compressed fluid/lubricant stream in passage 69 and is flowed out discharge end 66 to inlet valve 20. In this way, lubricant collected in cavity 22 is drained from the cavity when the compressor is continuously running loaded. An additional benefit of system 60 is the vacuum produced in connector 60 is produced without supplying additional fluid to the compressor.

In addition to the foregoing, lubricant is drained from scavenge cavity 22 by system 60 when the inlet valve 20 is closed and the compressor is unloaded, using conventional methods.

Figure 2:
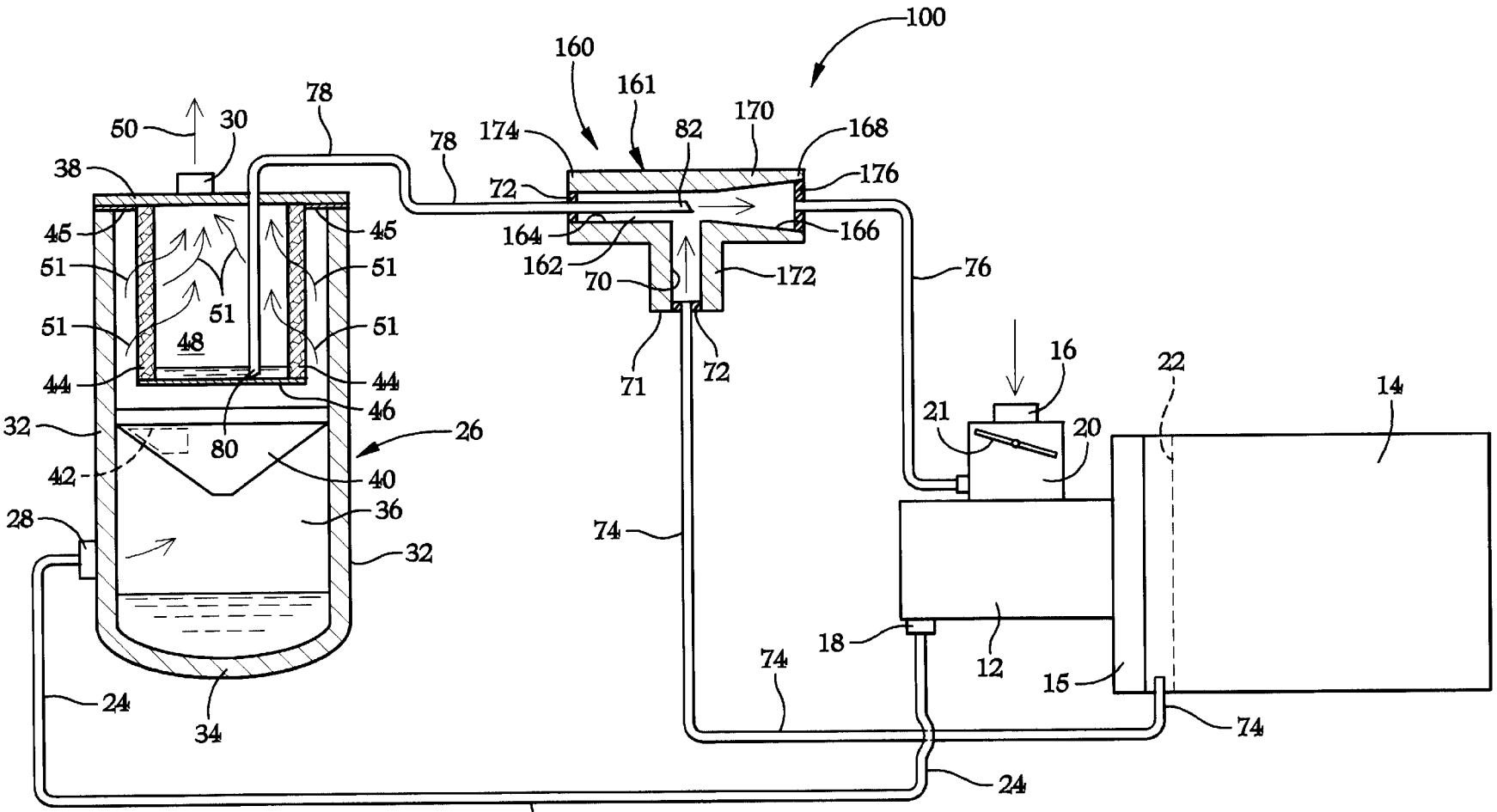

Now turning to FIG. 2 which discloses second embodiment fluid compressor identified generally at 100. Second embodiment fluid compressor 100 includes the compression module 12 with inlet 20, prime mover 14, adapter 15, and separator tank 26 described in the first embodiment fluid compressor 10.

The fluid compressor 100 includes scavenge system 160 with scavenge flow connector 161 which is the same as scavenge flow connector 61 except for passage 162. As shown in FIG. 2, passage 162 includes a constant diameter portion 164 and a variable diameter portion 166 that is wider than the constant diameter portion. The variable diameter portion is divergent and is widest at scavenge flow connector discharge end 168.

Scavenge flow connector 161 has a T-shaped housing comprised of tubular conduit 170 having first inlet end 174 and discharge end 168 with the passage 162 joining the ends. Stem 172 is made integral with the tubular conduit halfway between the ends 174 and 168. Stem passage 70 joins the second inlet end 71 and the passage 162 at the constant diameter portion 164.

Seal members 72 are located in conduit end 174 and stem end 71, and seal member 176 is located in the wide discharge end 168.

Second embodiment fluid compressor 100 also includes flow lines 74, 76, and 24, which flow connect components of fluid compressor 100 as described hereinabove.

The second embodiment fluid compressor 100 also includes flow line 78 with a first end located in secondary separation chamber 48 closely adjacent base plate 46, and a second end 82 located in passage 162. As shown in FIG. 2, the flow line second end is 82 is located in passage 162 in constant diameter portion 164, downstream from passage 70.

Fluid compressor 100 drains lubricant from the scavenge cavity 22 in the manner previously described in conjunction with fluid compressor 10.

While I have illustrated and described a preferred embodiment of our invention, it is understood that this is capable of modification, and I therefore do not wish to be limited to the precise details set forth, but desire to avail myself of such changes and alterations as fall within the purview of the following claims.

Having described the invention, what is claimed is:

1. A fluid compressor, comprising:

A) a compression module having a fluid inlet for flowing uncompressed fluid into the compression module and a discharge port for flowing compressed fluid out of the compression module;

B) a prime mover for driving the compression module;

C) adapter means for mating the prime mover and compression module said adapter means and prime mover defining a scavenge cavity;

D) separator tank having a separator inlet, the separator inlet being flow connected in fluid receiving relation with the compression module discharge port, said separator vessel further including a separator element which defines a separation chamber;

E) a scavenge system comprising; a scavenge flow connector having a scavenge housing with a first scavenge housing inlet port, a second scavenge housing inlet port, a scavenge housing discharge port, a first passage flow connecting the first scavenge housing inlet port and the scavenge housing discharge port, a second passage flow connecting the second scavenge housing inlet port and the first passage, said system also comprising a separator scavenge line having a first end located in the separation chamber and a second end located in the first passage;

F) a first flow line flow connecting the scavenge cavity with the second scavenge housing inlet port; and G) a second flow line flow connecting the scavenge housing discharge port with the compression module fluid inlet.

2. The fluid compressor as claimed in claim 1 wherein the scavenge flow connector housing is T-shaped and is comprised of a tubular conduit with a pair of ends and a stem made integral with the tubular conduit, said stem having an end.

3. The fluid compressor as claimed in claim 2 wherein the first scavenge housing inlet and scavenge housing discharge port are located at the ends of the tubular conduit, and the second scavenge housing inlet is located at the end of the stem.

4. The fluid compressor as claimed in claim 2 wherein the stem is located between the tubular conduit ends.

5. The fluid compressor as claimed in claim 4 wherein the stem is located halfway between the tubular conduit ends.

6. The fluid compressor as claimed in claim 1 wherein the first passage has a constant diameter.

7. The fluid compressor as claimed in claim 1 wherein the first passage has a constant diameter portion and a variable diameter portion.

8. The fluid compressor as claimed in claim 7 wherein the wide portion is divergent away from the constant diameter portion of the first passage.

9. The fluid compressor as claimed in claim 1 wherein the second end of the separator scavenge line is located halfway between the first scavenge housing inlet port and the scavenge housing discharge port.

10. The fluid compressor as claimed in claim 5 wherein the second end of the separator scavenge line is located adjacent to the second passage.

11. The fluid compressor as claimed in claim 1, wherein the scavenge flow connector further includes seal members seated in the first and second scavenge housing inlet ports and in the scavenge housing discharge port.

12. The fluid compressor as claimed in claim 1 wherein the compression module is an oil-flooded airend.

13. The fluid compressor as claimed in claim 1, the compression module fluid inlet having an upstream end and a downstream end, said second flow line being flow connected to the inlet valve at the downstream end.

14. A fluid compressor comprising: a compression module driven by a prime mover, an adapter means for mating the prime mover and compression module, said adapter means and prime mover defining a scavenge cavity, a separator tank having a separation chamber, a scavenge flow connector having a T-shaped housing that is adapted to produce scavenge vacuum pressure to drain lubricant from the scavenge cavity when the fluid compressor is continuously running loaded, said fluid compressor also comprising flow lines, connecting the scavenge cavity, separator tank and compression module to the scavenge flow connector.

15. In a fluid compressor comprised of a compression module driven by a prime mover, adapter means for mating said prime mover and compression module, said adapter and prime mover defining a scavenge cavity, a separator tank having a separation chamber, a scavenge flow connector having a housing with a first flow passage and a second flow passage, the housing adapted to produce scavenge vacuum pressure in the second passage to drain lubricant from the scavenge cavity when the fluid compressor is continuously running loaded, said fluid compressor also comprising flow lines, flow connecting the scavenge cavity, separator tank and compression module to the scavenge flow connector, the method comprising the steps of:

A) drawing uncompressed fluid into the compression module, compressing the fluid and discharging a fluid mixture comprised of compressed fluid and a compressed fluid lubricant;

B) flowing the fluid mixture to a separator tank, separating substantially all of the compressed fluid lubricant from the fluid mixture and capturing the separated lubricant in a separation chamber;

C) flowing the separated lubricant and a volume of compressed fluid from the separation chamber and flowing the separated lubricant and volume of compressed fluid through the first passage in the scavenge flow connector thereby forming a vacuum in the second passage;

D) draining the scavenged lubricant from the scavenge cavity through the second passage and into the first passage.

16. The method as claimed in claim 15 comprising the further step, of after step D), mixing the separated lubricant and volume of compressed fluid with the scavenged lubricant in the first passage to form a scavenge mixture.

17. The method as claimed in claim 16 wherein the compression module includes an inlet valve with a downstream end, the method comprising the further step of injecting the scavenge mixture into the inlet valve at the downstream end.

* * * * *